US005376490A

United States Patent [19]

Sasaki et al.

[11] Patent Number: 5,376,490

[45] Date of Patent: Dec. 27, 1994

[54] ENCAPSULATED TONER FOR HEAT-AND-PRESSURE FIXING AND METHOD FOR PRODUCTION THEREOF

[75] Inventors: Mitsuhiro Sasaki; Kuniyasu Kawabe, both of Wakayama, Japan

[73] Assignee: Kao Corporation, Tokyo, Japan

[21] Appl. No.: 986,739

[22] Filed: Dec. 8, 1992

[30] Foreign Application Priority Data

Dec. 10, 1991 [JP] Japan ..... 3-350837
Jan. 17, 1992 [JP] Japan ..... 4-027257

[51] Int. Cl.[5] ..... G03G 9/093

[52] U.S. Cl. ..... 430/109; 430/137; 430/138

[58] Field of Search ..... 430/109, 137, 138

[56] References Cited

U.S. PATENT DOCUMENTS 5,229,243 7/1993 Sasaki et al. ..... 430/109

FOREIGN PATENT DOCUMENTS 59-123847 7/1984 Japan .

60-69659 4/1985 Japan .

*Primary Examiner*—Marion E. McCamish
*Assistant Examiner*—Rosemary Ashton
*Attorney, Agent, or Firm*—Birch, Stewart, Kolasch & Birch

[57] ABSTRACT

The present invention is directed to an encapsulated toner for heat-and-pressure fixing, which has a heat-fusible core material containing at least a coloring agent and a shell formed thereon so as to cover the surface of the core material. The core material includes a thermoplastic resin as its main components produced by a polymerization reaction, at the time of encapsulation, of 0.05 to 20 parts by weight of the (A) $\alpha,\beta$-ethylenic copolymerizable monomer having an acid anhydride group and 99.95 to 80 parts by weight of the (B) other $\alpha,\beta$-ethylenic copolymerizable monomer. Alternatively, the core material contains a copolymer having one or more acid anhydride groups added as one component of the core material resin-constituting material at the time of encapsulation.

14 Claims, No Drawings

ENCAPSULATED TONER FOR HEAT-AND-PRESSURE FIXING AND METHOD FOR PRODUCTION THEREOF

FIELD OF THE INVENTION

The present invention relates to an encapsulated toner for heat-and-pressure fixing used in electrostatic image development in electrophotography, electrostatic printing, electrostatic recording, etc. and a method for production of such an encapsulated toner.

BACKGROUND OF THE INVENTION

As described in US Patent Nos. 2,297,691 and 2,357,809 and other publications, conventional electrophotography comprises the steps of forming an electric latent image by evenly charging a photoconductive insulating layer and subsequently exposing the layer to eliminate the charge in the exposed portion and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

As stated above, a toner must meet the requirements not only in the development process but also in the transfer process and fixing process.

Generally, a toner undergoes mechanical frictional forces due to shear force and impact force during the mechanical operation in a developer device, thereby deteriorating after copying from several thousand to several tens of thousand sheets. Such deterioration of the toner can be prevented by using a tough resin having such a high molecular weight as to withstand the above mechanical friction. However, this kind of a resin generally has such a high softening point that the resulting toner cannot be sufficiently fixed by a non-contact method such as oven fixing or radiant fixing with infrared rays, because of its poor thermal efficiency. Further, when the toner is fixed by a contact fixing method such as a heat-and-pressure fixing method using a heat roller, etc., which is excellent in thermal efficiency and therefore widely used, it becomes necessary to raise the temperature of the heat roller in order to achieve sufficient fixing of the toner, which brings about such disadvantages as deterioration of the fixing device, curling of paper and an increase in energy consumption. Furthermore, the resin described above is poor in grindability, thereby remarkably lowering the production efficiency of the toner upon the production of the toner. Accordingly, the binding resin having too high a degree of polymerization and a softening point cannot be used therefor.

Meanwhile, according to the heat-and-pressure fixing method using a heat roller, etc., the surface of a heat roller contacts the surface of a visible image formed on an image-receiving sheet under pressure, so that the thermal efficiency is excellent and therefore widely used in various copying machines from those of high-speed ones to those of low-speed ones. However, when the surface of a heat roller contacts the surface of the visible image, the toner is likely to cause a so-called off-set or offset phenomenon, wherein the toner is adhered to the surface of the heat roller, and thus transferred to a subsequent transfer paper. In order to prevent this phenomenon, the heat roller is treated with a material excellent in release properties, such as a fluororesin, and further a releasing agent such as silicone oil is applied thereon. However, the method of applying a silicone oil, etc. necessitates a larger-scale fixing device, which is not only expensive but also complicated, which in turn may undesirably become causative of various problems.

Although processes for improving the offset phenomenon by unsymmetrizing or crosslinking the resins have been disclosed in Japanese Patent Examined Publication No. 493/1982 and Japanese Patent Laid-Open Nos. 44836/1975 and 37353/1982, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature of causing high-temperature offsetting as much as possible, the service fixing temperature can be lowered and the serviceable temperature range can be widened, which enables energy saving, high-speed fixing and prevention of the curling of paper.

From the above reasons, the development of a toner excellent in fixing ability and offset resistance has always been expected.

There has been proposed a method for achieving improvement on the low-temperature fixing ability by using a toner comprising a core material and a shell formed thereon so as to cover the surface of the core material.

Among such toners, those having a core material made of a low-melting wax which is easily plastically deformable, as described in U.S. Pat. No. 3,269,626, Japanese Patent Examined Publication Nos. 15876/1971 and 9880/1969, and Japanese Patent Laid-Open Nos. 75032/1973 and 75033/1973, are poor in fixing strength and therefore can be used only in limited fields, although they can be fixed only by pressure.

Further, with respect to toners having a liquid core material, when the strength of the shell is low, the toners tend to break in the developing device and stain the inside thereof, even though they can be fixed only by pressure. On the other hand, when the strength of the shell is high, a higher pressure is necessitated in order to break the capsule, thereby giving too glossy images. Thus, it has been difficult to control the strength of the shell.

Further, there has been proposed, as a toner for heat-and-pressure fixing, a toner of a microcapsule type for heat roller fixing which comprises a core material made of a resin having a low glass transition temperature which serves to enhance the fixing strength, though blocking at a high temperature may take place if used alone, and a shell made of a high-melting point resin which forms a wall by interfacial polymerization for the purpose of imparting blocking resistance, etc. of the toner (see Japanese Patent Laid-Open No. 56352/1986). However, this toner cannot fully exhibit the performance of the core material, because the melting point of the shell material is too high. Further, it has been difficult to freely control the chargeability of the shell formed by interfacial polymerization. On the same line of thinking as that described above, encapsulated toners for heat roller fixing with an improved fixing strength of the core material have been proposed (see Japanese Patent Laid-Open Nos. 128357/1988, 128358/1988, 128359/1988, 128360/1988, 128361/1988 and 128362/1988). However, since these toners are prepared by a spray drying method, a higher load to the equipments for the production thereof becomes necessary. In addition, they cannot fully exhibit the performance of the core material, because they have not come up with a solution for the problems in the shell.

Further, there have been attempts to control the chargeability of the encapsulated toner in the presence of a charge control agent in the shell of the encapsulated toner or on the surface of the encapsulated toner. However, in the developing process, since the charge control agent becomes detached from the toner due to friction with carrier, etc. and is adhered to the carrier, the electric charge of the resulting toner is lowered, thereby causing such problems as background contamination and scattering of the toner in the developer device. In addition, when no charge control agents are present on the surface of the toner, charging speed may become slow depending upon the type of carriers, thereby causing background contamination, scattering of the toner, etc. in the case of quick printing.

SUMMARY OF THE INVENTION

The present invention has been found under these circumstances, and an object thereof is to provide an encapsulated toner for heat-and-pressure fixing which is excellent in offset resistance, fixable even at a low temperature and excellent in blocking resistance when the encapsulated toner is used for heat-and-pressure roller fixing using a heat roller, etc.

Another object of the present invention is to provide a method for production of such an encapsulated toner.

A further object of the present invention is to provide an encapsulated toner for heat-and-pressure fixing, wherein a clear image free from background contamination is stably formed after a large amount of copying by controlling the chargeability of the toner from the inner portion of the encapsulated toner.

A still further object of the present invention is to provide a method for production of such an encapsulated toner.

Therefore, in view of solving the above-mentioned problems, the present inventors have investigated an encapsulated toner for heat-and-pressure fixing, and have thus developed the present invention.

More particularly, the present invention essentially relates to:

(1) An encapsulated toner for heat-and-pressure fixing comprising a heat-fusible core material containing at least a coloring agent and a shell formed thereon so as to cover the surface of the core material, wherein said core material comprises a thermoplastic resin as its main components produced by a polymerization reaction, at the time of encapsulation, between 0.05 to 20 parts by weight of the (A) $\alpha,\beta$-ethylenic copolymerizable monomer having an acid anhydride group and 99.95 to 80 parts by weight of the (B) other $\alpha,\beta$-ethylenic copolymerizable monomer.

(2) An encapsulated toner for heat-and-pressure fixing comprising a heat-fusible core material containing at least a coloring agent and a shell formed thereon so as to cover the surface of the core material, wherein said core material contains a copolymer having one or more acid anhydride groups added as one component of the core material resin-constituting material at the time of encapsulation. Specifically, an excellent performance of the toner can be more fully exhibited when said copolymer having one or more acid anhydride groups is a copolymer consisting of styrene and maleic anhydride, and the content of said copolymer in the heat-fusible core material is 0.1 to 30.0% by weight;

(3) The encapsulated toner for heat-and-pressure fixing described in (1) or (2) above, wherein the main components of the shell are a resin prepared by reacting:

(A) an isocyanate and/or isothiocyanate compound comprising:

(1) 0 to 30 mol % of a monovalent isocyanate and/or isothiocyanate compounds, and (2) 100 to 70 mol % of at least a divalent isocyanate and/or isothiocyanate compounds with (B) an active hydrogen compound comprising:

(3) 0 to 30 mol % of a compound having one active hydrogen atom reactive with the isocyanate and/or isothiocyanate groups and (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the bonds formed from the isocyanate and/or isothiocyanate groups are thermally dissociating bonds;

(4) In the present invention, it is preferred that the thermally dissociating bond is a bond derived from reacting phenolic hydroxyl and/or thiol groups with the isocyanate and/or isothiocyanate groups, and an excellent performance of the toner can be more fully exhibited when the glass transition temperature assignable to a thermoplastic resin used as the main component of the heat-fusible core material is 10° C. to 50° C., and when the encapsulated toner has a softening point of 80° to 150° C.;

(5) A method for production of an encapsulated toner for heat-and-pressure fixing comprising a heat-fusible core material containing at least a coloring agent and a shell formed thereon so as to cover the surface of the core material, having the step of forming a heat-fusible core material by using a thermoplastic resin as its main components produced by a polymerization reaction, at the time of encapsulation, between 0.05 to 20 parts by weight of the (A) $\alpha,\beta$-ethylenic copolymerizable monomer having an acid anhydride group and 99.95 to 80 parts by weight of the (B) other $\alpha,\beta$-ethylenic copolymerizable monomer;

(6) A method for production of an encapsulated toner for heat-and-pressure fixing comprising a heat-fusible core material containing at least a coloring agent and a shell formed thereon so as to cover the surface of the core material, having the step of forming a heat-fusible core material by using a copolymer having one or more acid anhydride groups added as one component of said core material resin-constituting material at the time of encapsulation; and (7) The method for production of an encapsulated toner for heat-and-pressure fixing described in (5) or (6) above, having the step of forming a shell by using the resin described in (3) above as its main components.

The encapsulated toner for heat-and-pressure fixing of the present invention described above has well-controlled chargeability from the inner portion of the toner, excellent offset resistance and fixing ability even at a low fixing temperature by utilizing the heat-and-pressure fixing method using a heat roller, etc. In addition, since the encapsulated toner has an excellent blocking resistance, clear images free from background contamination can be stably formed for a large amount of copying.

DETAILED DESCRIPTION OF THE INVENTION

According to the present invention, there are the following two embodiments for the components of the core material:

(1) First Embodiment:

The case where the core material comprises a thermoplastic resin as its main components produced by a polymerization reaction, at the time of encapsulation, of 0.05 to 20 parts by weight of the (A) $\alpha,\beta$-ethylenic copolymerizable monomer having an acid anhydride group with 99.95 to 80 parts by weight of the (B) other $\alpha,\beta$-ethylenic copolymerizable monomer (2) Second Embodiment The case where the core material contains a copolymer having one or more acid anhydride groups added as one component of the core material resin-constituting material at the time of encapsulation.

The differences between the two embodiments are as follows: In the first embodiment, the core material resin-constituting material comprises the (A) $\alpha,\beta$-ethylenic copolymerizable monomer having an acid anhydride group and the (B) other $\alpha,\beta$-ethylenic copolymerizable monomer as described above, and these monomers are polymerized at the time of encapsulation to form a thermoplastic resin as the main component of the core material. By contrast, in the second embodiment, the copolymer having one or more acid anhydride groups produced in advance is used as one component of the core material resin-constituting material at the time of encapsulation, so that the resulting core material of the encapsulated toner contains the above copolymer as one component thereof.

The first embodiment will now be described below.

Among the core material resin-constituting monomers used in the first embodiment, examples of the (A) $\alpha,\beta$-ethylenic copolymerizable monomers having an acid anhydride group include itaconic anhydride, crotonic anhydride, etc. and the compounds represented by the following formula:

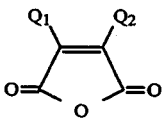

wherein $Q_1$ and $Q_2$ independently represents a hydrogen atom, an alkyl group having 1 to 3 carbon atoms or a halogen atom, which may be exemplified by maleic anhydride, citraconic anhydride, 2,3-dimethylmaleic anhydride, chloromaleic anhydride, dichloromaleic anhydride, bromomaleic anhydride, dibromomaleic anhydride, etc., with preference given to maleic anhydride, citraconic anhydride, etc.

By using these acid anhydride group-containing monomers, the charge control can be achieved from the inner portion of the encapsulated toner, and its amount is usually 0.05 to 20 parts by weight, preferably 0.1 to 15 parts by weight. When the core material resin-constituting monomer is less than 0.05 parts by weight, sufficient effects on the improvement of the charge control cannot be achieved, and when it exceeds 20 parts by weight, the polymerization becomes undesirably unstable, particularly in the case of preparing the encapsulated toner by an interfacial polymerization.

Examples of (B) the other $\alpha,\beta$-ethylenic copolymerizable monomers constituting the core material include styrene and styrene derivatives such as styrene, o-methylstyrene, m-methylstyrene, p-methylstyrene, $\alpha$-methylstyrene, p-ethylstyrene, 2,4-dimethylstyrene, p-chlorostyrene and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl $\alpha$-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate and phenyl methacrylate; substituted monomers with ethylenic monocarboxylic acids such as acrylonitrile, methacrylonitrile and acrylamide; ethylenic dicarboxylic acids and substituted monomers therewith such as dimethyl maleate; vinyl ketones such as vinyl methyl ketone; vinyl ethers such as vinyl methyl ether; vinylidene halides such as vinylidene chloride. Among the core material-constituting resins according to the first embodiment, styrene and styrenic derivatives are preferably used for the purpose of forming the main chain of the resin, and ethylenic monocarboxylic acids and esters thereof are preferably used for the purpose of adjusting the thermal properties such as softening point of the resin.

Next, the second embodiment will be described below.

Examples of the copolymers having one or more acid anhydride groups used in the second embodiment, which is added as one component of the core material resin-constituting material at the time of encapsulation, include a copolymer consisting of the (A) $\alpha,\beta$-ethylenic copolymerizable monomer having an acid anhydride group and the (B) other $\alpha,\beta$-ethylenic copolymerizable monomer, etc.

As the (A) $\alpha,\beta$-ethylenic copolymerizable monomer having an acid anhydride group, the examples thereof may be the same ones as those described in the first embodiment, with preference similarly given to maleic anhydride, citraconic anhydride, etc. As the (B) other $\alpha,\beta$-ethylenic copolymerizable monomer, the examples thereof may be the same ones as those described in the first embodiment, with preference given to styrene and (meth)acrylate from the viewpoint of high reactivity.

The copolymer used in the second embodiment can be obtained by a polymerization reaction, at the time of encapsulation, between 5 to 95 parts by weight of the (A) $\alpha,\beta$-ethylenic copolymerizable monomer having an acid anhydride group described above with 95 to 5 parts by weight of the (B) other $\alpha,\beta$-ethylenic copolymerizable monomer. The polymerization reaction can be carried by conventional addition polymerizations, etc., but it is not limitative to these methods.

In addition, by using the copolymer obtained by using an acid anhydride group-containing monomer as described above, the charge control from the inner portion of the encapsulated toner can be achieved. In the present invention, the content of the copolymer having one or more acid anhydride groups in the heat-fusible core material is usually 0.1 to 30.0% by weight, preferably 0.3 to 20.0% by weight. When it is less than 0.1% by weight, sufficient effects on the improvement of the charge control from the inner portion of the encapsulated toner cannot be achieved, and when it exceeds 30.0% by weight, the viscosity before polymerization becomes high in the case of interfacial polymerization or suspension polymerization, thereby making the production of the encapsulated toner difficult.

According to the second embodiment, the resins to be used as the main components of the core materials of the encapsulated toner according to the present invention are thermoplastic resins having glass transition temperatures (Tg) of not less than 10° C. and not more than 50° C., and examples thereof include polyester resins, polyester-polyamide resins, polyamide resins and vinyl resins, among which vinyl resins are particularly preferable.

Examples of the monomers constituting the vinyl resins include styrene and its derivatives such as styrene, o-methylstyrene, m-methylstyrene, p-methylstyrene, $\alpha$-methylstyrene, p-ethylstyrene, 2,4-dimethylstyrene, p-chlorostyrene and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl $\alpha$-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers with ethylenic monocarboxylic acids such as acrylonitrile, methacrylonitrile and acrylamide; ethylenic dicarboxylic acids and substituted monomers therewith such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting monomers according to the second embodiment, styrene or its derivatives is preferably used in an amount of 50 to 90 parts by weight for forming the main chain of the resins, and the ethylenic monocarboxylic acid or esters thereof is preferably used in an amount of 10 to 50 parts by weight to adjust the thermal properties such as the softening point of the resin.

In both embodiments, when a crosslinking agent is added to the monomer composition constituting the core material-forming resin according to the present invention, any known crosslinking agents may be properly used. Examples thereof include divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate, with preference given to divinylbenzene and polyethylene glycol dimethacrylate. These crosslinking agents may be used, if necessary, in a combination of two or more.

The amount of these crosslinking agents is preferably 0.001 to 15% by weight, more preferably 0.1 to 10% by weight, based on the polymerizable monomers. When the amount of these crosslinking agents is more than 15% by weight, the resulting toner is less likely to be heat-fused, thereby resulting in poor heat fixing ability and heat-and-pressure fixing ability. On the contrary, when the amount is less than 0.001% by weight, in heat-and-pressure fixing, a part of the toner cannot be completely fixed on a paper but rather adheres to the surface of a roller, which in turn is transferred to a subsequent paper, namely an offset phenomenon takes place.

A graft or crosslinked polymer prepared by polymerizing the above monomers in the presence of an unsaturated polyester may be also used as the resin for the core material.

Examples of the polymerization initiators to be used in the production of the thermoplastic resin include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, etc., two or more polymerization initiators may be used in combination. The amount of the polymerization initiator to be used is 0.1 to 20 parts by weight, preferably 1 to 10 parts by weight per 100 parts by weight of the monomers to be polymerized.

In both embodiments, the charge control agent may be further added to the core material. Negative charge control agents to be added are not particularly limitative, and examples thereof include azo dyes containing metals such as "Varifast Black 3804"

(manufactured by Orient Chemical), "Bontron S-31"

(manufactured by Orient Chemical), "Bontron S-32"

(manufactured by Orient Chemical), "Bontron S-34"

(manufactured by Orient Chemical), "Aizenspilon Black TRH"

(manufactured by Hodogaya Kagaku), etc.; copper phthalocyanine dye; metal complexes of alkyl derivatives of salicylic acid such as "Bontron E-81" (manufactured by Orient Chemical), "Bontron E-82" (manufactured by Orient Chemical), and "Bontron E-85" (manufactured by Orient Chemical); quaternary ammonium salts such as "Copy Charge NX VP434" (manufactured by Hoechst); nitroimidazole derivatives, etc., with preference given to Bontron S-34 and Aizenspilon Black TRH.

The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), "Bontron N-11," etc. (manufactured by Orient Chemical); triphenylmethane dyes containing tertiary amines as side chains; quaternary ammonium salt compounds such as "Bontron P-51" (manufactured by Orient Chemical), cetyltrimethylammonium bromide, "Copy Charge PX VP435" (manufactured by Hoechst); polyamine resins such as "AFP-B" (manufactured by Orient Chemical); imidazole derivatives, etc., with preference given to Bontron N-01.

The above charge control agents may be contained in an amount of 0.1 to 8.0% by weight, preferably 0.2 to 5.0% by weight, in the core material.

In both embodiments, if necessary, the core material may contain one or more arbitrary offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

Examples of the above polyolefins include resins such as polypropylene, polyethylene, polybutene, etc. and having a softening point of 80° to 160° C. Examples of the above metal salts of fatty acids include metal salts of maleic acid with zinc, magnesium, calcium, etc.; metal salts of stearic acid with zinc, cadmium, barium, lead, iron, nickel, cobalt, copper, aluminum, magnesium, etc.; dibasic lead stearate; metal salts of oleic acid with zinc, magnesium, iron, cobalt, copper, lead, calcium, etc.; metal salts of palmitic acid with aluminum, calcium, etc.; caprylates; lead caproate; metal salts of linoleic acid with zinc, cobalt, etc.; calcium ricinoleate; metal salts of ricinoleic acid with zinc, cadmium, etc.; and mixtures thereof. Examples of the above fatty acid esters include ethyl maleate, butyl maleate, methyl stearate, butyl stearate, cetyl palmirate, ethylene glycol montanate, etc. Examples of the above partially saponified fatty acid esters include partially calcium-saponified montanate, etc. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, etc., and mixtures thereof. Examples of the above higher alcohols include dodecyl alcohol, lauryl alcohol, myristyl alcohol, palmityl alcohol, stearyl alcohol, arachyl alcohol, behenyl alcohol, etc. Examples of the above paraffin waxes include natural paraffins, microwaxes, synthetic paraffins, chlorinated hydrocarbons, etc. Examples of the above amide waxes include stearamide, oleamide, palmitamide, lauramide, behenamide, methylenebisstearamide, ethylenebisstearamide, N,N '-m-xylylenebisstearamide, N,N '-m-xylylenebis-12-hydroxystearamide, N,N '-isophthalic bisstearylamide and N,N '-isophthalic bis-12-hydroxystearylamide. Examples of the above polyhydric alcohol esters include glycerol stearate, glycerol ricinolate, glycerol monobehenate, sorbitan monostearate, propylene glycol monostearate, sorbitan trioleate, etc. Examples of the above silicone varnishes include methylsilicone varnish, phenylsilicone varnish, etc. Examples of the above aliphatic fluorocarbons include oligomers of tetrafluoroethylene, and hexafluoropropylene and fluorinated surfactants disclosed in Japanese Patent Laid-Open No. 124428/1978. Among the above offset inhibitors, the preference is given to the polyolefins, with particular preference to polypropylene.

When the shell of the toner is formed by interfacial polymerization or in situ polymerization, however, the use of a large amount of a compound having an isocyanate-reactive functional group, for example, a higher fatty acid or higher alcohol, is not desirable, because the formation of the shell is hindered and the storage stability of the encapsulated toner becomes poor.

It is preferable to use the offset inhibitors in a proportion of 1 to 20% by weight based on the resin contained in the core material.

In the present invention, a coloring agent is contained in the core material of the encapsulated toner, and any of the conventional dyes, pigments, etc. which have been used for coloring agents for the toners may be used.

Examples of the coloring agents used in the present invention include various carbon blacks which may be produced by a thermal black method, an acetylene black method, a channel black method, a lamp black method, etc.; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, etc., and mixtures thereof. The coloring agent is usually used in an amount of about 1 to 15 parts by weight based on 100 parts by weight of the resin in the core material.

A magnetic encapsulated toner can be prepared by adding a particulate magnetic material to the core material. Examples of the particulate magnetic materials include ferromagnetic metals such as iron, cobalt, nickel, etc., alloys thereof, and compounds containing these elements such as ferrite and magnetite; alloys not containing any ferromagnetic element which become ferromagnetic by suitable thermal treatment, for example, so-called "Heusler alloys" containing manganese and copper such as a manganese-copper-aluminum alloy, a manganese-copper-tin alloy, etc.; chromium dioxide, etc., with preference given to the compounds containing ferromagnetic materials, and particular preference to magnetite. Such a magnetic material is uniformly dispersed in the core material in the form of a fine powder having an average particle diameter of 0.1 to 1 μm. The content of these magnetic materials is 20 to 70 parts by weight, preferably 30 to 70 parts by weight per 100 parts by weight of the encapsulated toner.

When a particulate magnetic material is incorporated into the core material in order to make it a magnetic toner, the material may be treated in a similar manner to that of the coloring agent. Since a particulate magnetic material as such is poor in the affinity for organic substances such as core materials and monomers, the material is used together with a known coupling agent such as a titanium coupling agent, a silane coupling agent or a lecithin coupling agent, with preference given to the silane coupling agent, or is treated with such a coupling agent prior to its use, thereby making it possible to uniformly disperse the particulate magnetic materials.

According to the present invention, the main components of the shell of the encapsulated toner for heat-and-pressure fixing are a resin prepared by reacting:

(A) an isocyanate and/or isothiocyanate compound comprising:
  (1) 0 to 30 mol % of a monovalent isocyanate and/or isothiocyanate compounds, and
  (2) 100 to 70 mol % of at least a divalent isocyanate and/or isothiocyanate compounds with (B) an active hydrogen compound comprising:
  (3) 0 to 30 mol % of a compound having one active hydrogen atom reactive with the isocyanate and/or isothiocyanate groups and
  (4) 100 to 70 mol % of a compound having at least two active hydrogen atoms reactive with the isocyanate and/or isothiocyanate groups at a molar ratio of the component (A) to the component (B) of between 1:1 and 1:20, and it is preferable that at least 30% of all of the bonds formed from the isocyanate and/or isothiocyanate groups are thermally dissociating bonds.

According to the present invention, the "thermally dissociating bond" means a bond which is formed by the reaction of the isocyanate and/or isothiocyanate groups with the active hydrogen compound, to form an amide bond, a urethane bond, a urea bond, a thioamide bond, a thiourethane bond, a thiourea bond, etc., and may be broken upon heating to recover an isocyanate group or an isothiocyanate group, and that the bond shows a dissociation equilibrium property until reaching such a temperature. Here, the temperature at which the bond is broken is preferably not less than 200° C. In the present invention, among the bonds mentioned above, preference is given to those formed by the reaction of the phenolic hydroxyl group and/or thiol group with the isocyanate group and/or the isothiocyanate group. For example, a thermally dissociating urethane bond means that the bond dissociates into an isocyanate group and a hydroxyl group at a certain temperature, and is well known in the field of paints as "block isocyanate."

The blocking of the polyisocyanates is well known as means for temporarily inhibiting the reaction between an isocyanate group and an active hydrogen compound, and various blocking agents such as tertiary alcohols, phenols, acetoacetates and ethyl malonate are disclosed in Z. W. Wicks, Jr., "Prog. in Org. Coatings," 3, 73 (1975), etc.

In the thermally dissociating polyurethane suitably used in the present invention, it is essential that the thermal dissociation temperature is low. As is seen from the results disclosed in G. R. Grittin and L. J. Willwerth, "Ind. Eng. Chem. Prod. Res. Develop.," 1, 265 (1962), etc., among various urethane bonds, a resin having a urethane bond formed by the reaction between an isocyanate compound and a phenolic hydroxyl group exhibits a low thermal dissociation temperature, and therefore is favorably used.

The thermal dissociation is an equilibrium reaction, and, for example, the reaction represented by the following formula is known to proceed from the right to left side of the equation upon increase in temperature.

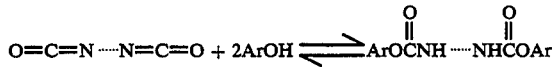

wherein Ar represents an aromatic group.

Examples of the monovalent isocyanate compounds to be used as the component (1) in the present invention include ethyl isocyanate, octyl isocyanate, 2-chloroethyl isocyanate, chlorosulfonyl isocyanate, cyclohexyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

Examples of the divalent or higher isocyanate compounds to be used as the component (2) in the present invention include aromatic isocyanate compounds such as 2,4-tolylene diisocyanate, 2,4-tolylene diisocyanate dimer, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane triisocyanate and polymethylenephenyl isocyanate; aliphatic isocyanate compounds such as hexamethylene diisocyanate, trimethylhexamethylene diisocyanate, lysine diisocyanate and dimer acid diisocyanates; alicyclic isocyanate compounds such as isophorone diisocyanate, 4,4'-methylenebis-(cyclohexyl isocyanate), methylcyclohexane-2,4(or 2,6)-diisocyanate and 1,3-(isocyanatomethyl)cyclohexane; and other isocyanate compounds such as an adduct of 1 mol of trimethylolpropane with 3 mol of tolylene diisocyanate.

Among these isocyanate and isothiocyanate compounds, compounds having an isocyanate group directly bonded to an aromatic ring are preferred, because they are effective in lowering the thermal dissociation temperature of the urethane bond formed.

Examples of the isothiocyanate compounds include phenyl isothiocyanate, xylylene-1,4-diisothiocyanate, ethylidene diisothiocyanate, etc.

According to the present invention, the monovalent isocyanate and/or isothiocyanate compound (1) also serves as a molecular weight modifier for the shell-forming resin and can be used in an amount of at most 30 mol % based on the isocyanate component and/or the isothiocyanate component. When the amount exceeds 30 mol %, the storage stability of the obtained encapsulated toner is undesirably poor.

According to the present invention, examples of compounds having one active hydrogen atom reactive with isocyanate and/or isothiocyanate groups to be used as component (3) in the present invention include aliphatic alcohols such as methyl alcohol, ethyl alcohol, propyl alcohol, isopropyl alcohol, butyl alcohol, isobutyl alcohol, tert-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol; aromatic alcohols such as phenol, o-cresol, m-cresol, p-cresol, 4-butylphenol, 2-sec-butylphenol, 2-tert-butylphenol, 3-tert-butylphenol, 4-tert-butylphenol, nonylphenol, isononylphenol, 2-propenylphenol, 3-propenylphenol, 4-propenylphenol, 2-methoxyphenol, 3-methoxyphenol, 4-methoxyphenol, 2-acetylphenol, 3-carbomethoxyphenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol; and amides such as ε-caprolactam, etc.

In particular, a phenol derivative represented by the following formula (I) is preferably used:

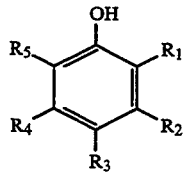

(I)

wherein $R_1$, $R_2$, $R_3$, $R_4$ and $R_5$ each independently represents a hydrogen atom, an alkyl Group having 1 to 9 carbon atoms, an alkenyl, alkoxy, alkanoyl, carboalkoxy or aryl group or a halogen atom.

Examples of the dihydric or higher alcohols among the compounds having at least two active hydrogen atoms reactive with isocyanate and/or isothiocyanate groups to be used as the component (4) in the present invention include catechol, resorcinol, hydroquinone, 4-methylcatechol, 4-tert-butylcatechol, 4-acetylcatechol, 3-methoxycatechol, 4-phenylcatechol, 4-methylresorcinol, 4-ethylresorcinol, 4-tert-butylresorcinol, 4-hexylresorcinol, 4-chlororesorcinol, 4-benzylresorcinol, 4-acetylresorcinol, 4-carbomethoxyresorcinol, 2-methylresorcinol, 5-methylresorcinol, tert-butylhydroquinone, 2,5-di-tert-butylhydroquinone, 2,5-di-tert-amylhydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(2-(p-hydroxyphenyl)propyl)benzene, bis(4-hydroxyphenyl)methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-tert-butylbenzyl alcohol, 4-hydroxy-3,5-di-tert-butylbenzyl alcohol, 4-hydroxyphenethyl alcohol, 2-hydroxyethyl 4-hydroxybenzoate, 2-hydroxyethyl 4-hydroxyphenylacetate, resorcinol mono-2-hydroxyethyl ether, hydroxyhydroquinone, gallic acid and ethyl 3,4,5-trihydroxybenzoate.

Among these dihydric or higher alcohols, catechol derivatives represented by the following formula (II) and resorcinol derivatives represented by the following formula (III) are preferably used:

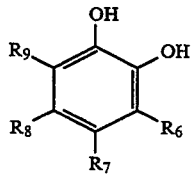

(II)

wherein $R_6$, $R_7$, $R_8$ and $R_9$ each independently represents a hydrogen atom, an alkyl group having 1 to 6 carbon atoms, an alkenyl, alkoxy, alkanoyl, carboalkoxy or aryl group or a halogen atom.

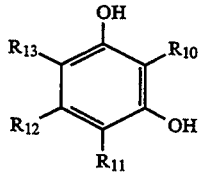

(III)

wherein $R_{10}$, $R_{11}$, $R_{12}$ and $R_{13}$ each independently represents a hydrogen atom, an alkyl group having 1 to 6 carbon atoms, an alkenyl, alkoxy, alkanoyl, carboalkoxy or aryl group or a halogen atom.

Further, examples of the compounds having at least one isocyanate- or isothiocyanate-reactive phenolic hydroxyl group include o-hydroxybenzoic acid, m-hydroxybenzoic acid, p-hydroxybenzoic acid, 5-bromo-2-hydroxybenzoic acid, 3-chloro-4-hydroxybenzoic acid, 4-chloro-2-hydroxybenzoic acid, 5-chloro-2-hydroxybenzoic acid, 3,5-dichloro-4-hydroxybenzoic acid, 3-methyl-2-hydroxybenzoic acid, 5-methoxy-2-hydroxybenzoic acid, 3,5-di-tert-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 3,4-dihydroxyphenylacetic acid, m-hydroxycinnamic acid, p-hydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino-5-naphthol-4-sulfonic acid, 2-amino-4-nitrophenol, 4-amino-2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid and 4-hydroxyphthalic acid.

Further, examples of the polythiol compounds having at least one isocyanate- or isothiocyanate-reactive thiol group in each molecule include ethanethiol, 1-propanethiol, 2-propanethiol, thiophenol, bis(2-mercaptoethyl)ether, 1,2-ethanedithiol, 1,4-butanedithiol, bis(2-mercaptoethyl) sulfide, ethylene glycol bis(2-mercaptoacetate), ethylene glycol bis(3-mercaptopropionate), 2,2-dimethylpropanediol bis(2-mercaptoacetate), 2,2-dimethylpropanediol bis(3-mercaptopropionate), trimethylolpropane tris(2-mercaptoacetate), trimethylolpropane tris(3-mercaptopropionate), trimethylolethane tris(2-mercaptoacetate), trimethylolethane tris(3-mercaptopropionate), pentaerythritol tetrakis(2-mercaptoacetate), pentaerythritol tetrakis(3-mercaptopropionate), dipentaerythritol hexakis(2-mercaptoacetate), dipentaerythritol hexakis(3-mercaptopropionate), 1,2-dimercaptobenzene, 4-methyl-1,2-dimercaptobenzene, 3,6-dichloro-1,2-dimercaptobenzene, 3,4,5,6-tetrachloro-1,2-dimercaptobenzene, xylylenedithiol and 1,3,5-tris(3-mercaptopropyl) isocyanurate.

In the thermally dissociating shell-forming resin used in the present invention, at least 30%, preferably at least 50% of all of the bonds formed from isocyanate or isothiocyanate groups are thermally dissociating bonds. When the content of the thermally dissociating bonds in all of the bonds formed from isocyanate or isothiocyanate groups is less than 30%, the strength of the shell in the heat-and-pressure fixing cannot be sufficiently lowered, making it less likely to fully exhibit any advantageous fixing performance of the core material.

In the present invention, other compounds having an isocyanate-reactive functional group other than phenolic hydroxyl and thiol groups, including, for example, the following active methylene group-containing compounds such as malonate and acetoacetate, oximes such as methyl ethyl ketone oxime, carboxylic acids, polyols, polyamines, aminocarboxylic acids and aminoalcohols, may be used as shell-forming materials in such an amount as not to lower the ratio of less than 30% in the bonds formed by the reaction of isocyanate and/or isothiocyanate groups with phenolic hydroxyl and/or thiol groups to the all of the bonds formed from isocyanate and/or isothiocyanate groups.

Examples of the above active methylene group-containing compounds include malonic acid, monomethyl malonate, monoethyl malonate, isopropyl malonate, dimethyl malonate, diethyl malonate, diisopropyl malonate, tert-butyl ethyl malonate, malondiamide, acetylacetone, methyl acetoacetate, ethyl acetoacetate, tert-butyl acetoacetate and allyl acetoacetate.

Examples of the above carboxylic acids include monocarboxylic acids such as acetic acid, propionic acid butyric acid, isobutyric acid, pentanoic acid, hexanoic acid, benzoic acid, etc., dicarboxylic acids such as maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, etc.; and tricarboxylic or higher acids such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, etc.

Examples of the above polyols include diols such as ethylene glycol, propylene glycol, butylene glycol, neopentyl glycol, hexamethylene glycol, diethylene glycol, dipropylene glycol, etc.; triols such as glycerol, trimethylolpropane, trimethylolethane, 1,2,6-hexanetriol, etc.; pentaerythritol and water. Examples of the above polyamines include ethylenediamine, hexamethylenediamine, diethylenetriamine, iminobispropylamine, phenylenediamine, xylylenediamine, triethylenetetramine, etc.

According to the present invention, the compound having one active hydrogen atom reactive with isocyanate and/or isothiocyanate groups as the component (3) may be used in an amount of at most 30 mol % based on the compounds reactive with isocyanate and/or isothiocyanate groups. When the amount exceeds 30 mol %, the storage stability of the resulting toner is undesirably poor.

Further, the molar ratio of (A) the isocyanate compound and/or isothiocyanate compound comprising the components (1) and (2) to (B) the active hydrogen compounds comprising the components (3) and (4) preferably lies between 1:1 and 1:20 in order to obtain a resin free from unreacted isocyanate groups.

In the encapsulated toner for heat-and-pressure fixing; there are two embodiments for the components of the core material thereof as described above. In the first embodiment, in the method for production of the encapsulated toner for heat-and-pressure fixing comprising a heat-fusible core material containing at least a coloring agent and a shell formed thereon so as to cover the surface of the core material, the core material comprises a thermoplastic resin as its main components produced by a polymerization reaction, at the time of encapsulation, of 0.05 to 20 parts by weight of the (A) $\alpha,\beta$-ethylenic copolymerizable monomer having an acid anhydride group with 99.95 to 80 parts by weight of the (B) other $\alpha,\beta$-ethylenic copolymerizable monomer. The polymerization reaction for producing this thermoplastic resin is usually carried out by an addition polymerization.

According to the second embodiment, in the method for production of the encapsulated toner for heat-and-pressure fixing of the present invention comprising a heat-fusible core material containing at least a coloring agent and a shell formed thereon so as to cover the surface of the core material, the core material contains a copolymer having one or more acid anhydride groups added as one component of the core material resin-constituting material at the time of encapsulation. By using such a copolymer having an acid anhydride group, the production for the encapsulated toner can be more stabilized when compared to the case where the core material resin is synthesized by using a monomer having an acid anhydride group at the time of encapsulation.

In the production of the encapsulated toner according to the present invention, the shell is preferably formed by an interfacial polymerization or an in-situ polymerization. Alternatively, it may be formed by a dry method comprising stirring in an air stream at a high rate matrix particles used as a core material together with particles used as a shell-forming material having a number-average particle size of one-eighth or less of that of the matrix particles. The main components of the shell are the resins as described above. These resins for forming the shell can be produced in the presence of no catalysts; however, when the resins are produced in the presence of catalysts, those catalysts including tin catalysts such as dibutyltindilaurate, etc.; amine catalysts such as 1,4-diazabicyclo[2.2.2[octane, N,N,N-tris-(dimethylaminopropyl)-hexahydro-S-triazine, etc.; and any known urethane catalysts can be used.

In the case of producing the encapsulated toner for heat-and-pressure fixing of the present invention by the interfacial polymerization method or the in situ polymerization method, the shell-forming materials and the core material-constituting materials described above are dispersed in the dispersion media, and a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphthol-disulfonate, colloidal silica, alumina, tricalcium phosphate, ferrous hydroxide, titanium hydroxide, aluminum hydroxide, etc., with preference given to tricalcium phosphate and sodium dodecylbenzenesulfonate. These dispersion stabilizers may be used in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, dioxane, etc., with preference given to water. These dispersion media can be used singly or in combination.

In addition, as a charge control agent, those conventionally used for toners including metal-containing dyes such as metal complexes of organic compounds containing a carboxyl group or a nitrogen atom; nigrosine dyes, etc. may be properly added to the shell-forming materials of the encapsulated toner. The charge control agent may be used in a mixture with a toner.

According to the present invention, it is preferred that the glass transition temperature assignable to the thermoplastic resin, which is a main component of the heat-fusible core material, is not less than 10° C. and not more than 50° C. When the glass transition temperature is less than 10° C., the storage stability of the encapsulated toner becomes poor, and when it exceeds 50° C., the fixing strength of the resulting encapsulated toner becomes undesirably poor. In the present invention, the "glass transition temperature" used herein refers to the temperature of an intersection of the extension of the baseline of not more than the glass transition temperature and the tangential line having the maximum inclination between the kickoff of the peak and the top thereof as determined using a differential scanning calorimeter (Seiko Instruments, Inc.), at a temperature rise rate of 10° C./min.

Further, in the present invention, the softening point of the encapsulated toner is preferably not less than 80° C. and not more than 150° C. When the softening point is less than 80° C., the offset resistance of the toner becomes poor, and when it exceeds 150° C., the fixing strength of the resulting encapsulated toner becomes poor. In the present invention, the "softening point" used herein refers to the temperature corresponding to one-half of the height (h) of the S-shaped curve showing the relationship between the downward movement of a plunger (flow rate) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

Although the particle diameter of the encapsulated toner according to the present invention is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner according to the present invention, a fluidity improver, a cleanability improver, etc. may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with preference given to finely powdered silica.

The finely powdered silica is a fine powder having Si—O—Si linkages, which may be prepared by either the dry process or the wet process. Although the finely powdered silica may be not only anhydrous silicon dioxide but also any one of aluminum silicate, sodium silicate, potassium silicate, magnesium silicate and zinc silicate, with preference given to those containing not less than 85% by weight of $SiO_2$. Further, finely powdered silica surface-treated with a silane coupling agent, a titanium coupling agent, silicone oil having amine in the side chain thereof, etc. can be used.

The cleanability improvers include fine powders of metal salts of higher fatty acids typically represented by zinc stearate or fluorocarbon polymers, etc.

Further, for the purpose of controlling the developability of the encapsulated toner, finely powdered polymethyl methacrylate or polybutyl methacrylate, etc. may be used.

Furthermore, for the purposes of toning or resistance control, a trace amount of carbon black may be used. The carbon blacks may be those of conventionally known, including various kinds such as furnace black, channel black, acetylene black, etc.

When the encapsulated toner of the present invention contains a particulate magnetic material, it can be used alone as a developer, while when the encapsulated toner does not contain any particulate magnetic material, a binary developer can be prepared by mixing the toner with a carrier. Although the carrier is not particularly limitative, examples thereof include iron powder, ferrite, glass bead, etc., and those of above with resin coatings. The mixing ratio of the toner to the carrier is 0.5 to 10% by weight. The particle diameter of the carrier is 30 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 190870/1990 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 162356/1990 in which the formed visible images are fixed on a recording medium through a film by using a heating element fixed to a support and a pressing member arranged opposite to the heating element in contact therewith under pressure.

EXAMPLES

The present invention is hereinafter described in more detail by means of the following working examples, comparative examples and test example, but the present invention is not limited by these examples.

EXAMPLE 1

To a mixture comprising 70.0 parts by weight of styrene, 29.0 parts by weight of 2-ethylhexyl acrylate, 1.0 part by weight of maleic anhydride and 0.8 parts by weight of divinylbenzene, 10.0 parts by weight of carbon black "#44" (manufactured by Mitsubishi Kasei Corporation), 4.0 parts by weight of 2,2'-azobisisobutyronitrile, 9.5 parts by weight of 4,4'-diphenylmethane diisocyanate "Millionate MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 22.0 g of resorcinol, 3.6 g of diethyl malonate and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, the dispersing agent is dissolved into 10%-aqueous hydrochloric acid. The resulting mixture is filtered, and the obtained solid is washed with water, dried under a reduced pressure of 20 mmhg at 45° C. for 12 hours and classified with an air classifier to give the encapsulated toner with an average particle size of 9 μm whose shell is made of a resin having a thermally dissociating urethane bond.

To 100 parts by weight of this encapsulated toner, 0.4 parts by weight of hydrophobic silica fine powder (Nippon Aerozil Ltd.: R-972) is added to obtain the toner according to the present invention. This toner is referred to as "Toner 1." The glass transition temperature assignable to the resin contained in the core material is 35.0° C., and the softening point of Toner 1 is 132.5° C.

EXAMPLE 2

The same procedure as that of Example 1 is repeated up to the surface treatment step except that 29.0 parts by weight of 2-ethylhexyl acrylate and 1.0 part by weight of maleic anhydride are replaced with 29.5 parts by weight of 2-ethylhexyl acrylate and 0.5 parts by weight of maleic anhydride to give an encapsulated toner. This toner is referred to as "Toner 2." The glass transition temperature assignable to the resin contained in the core material is 32.5° C., and the softening point of Toner 2 is 130.2° C.

EXAMPLE 3

40 parts by weight of styrene-grafted carbon black "GP-E-3" (manufactured by Ryoyu Kogyo), 5.0 parts by weight of lauroyl peroxide, 9.0 parts by weight of tolylene diisocyanate "Coronate T-100" (manufactured by Nippon Polyurethane Industry Co., Ltd.), and 0.5 parts by weight of phenyl isocyanate are added to a mixture comprising 50 parts by weight of styrene, 34 parts by weight of 2-ethylhexyl acrylate, 1.0 part by weight of citraconic anhydride and 1.0 part by weight of divinylbenzene to give a polymerizable composition.

This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 22.0 g of resorcinol, 3.0 g of m-aminophenol, 2.2 g of tert-butyl alcohol and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, the dispersing agent is dissolved into 10%-aqueous hydrochloric acid. The resulting mixture is filtered and the obtained solid is washed with water, dried under a reduced pressure of 20 mmhg at 45° C. for 12 hours and classified with an air classifier to give the encapsulated toner with an average particle size of 9 μm whose shell is made of a resin having a thermally dissociating urethane bond.

To 100 parts by weight of the encapsulated toner, 0.4 parts by weight of hydrophobic silica fine powder (Nippon Aerozil Ltd.: R-972) is added to obtain the toner according to the present invention. This toner is referred to as "Toner 3." The glass transition temperature assignable to the resin contained in the core material is 36.0° C., and the softening point of the Toner 3 is 134.0° C.

Comparative Example 1:

The same procedure as that of Example 1 is repeated up to the surface treatment step except that no maleic anhydride is used and that 2-ethylhexyl acrylate is used in an amount of 30.0 parts by weight to give an encapsulated toner. This toner is referred to as "Comparative Toner 1." The glass transition temperature assignable to the resin contained in the core material is 30.2° C., and the softening point of the Comparative Toner 1 is 130.0° C.

Comparative Example 2:

The same procedure as that of Example 3 is repeated up to the surface treatment step except that no citraconic anhydride is used and that 2-ethylhexyl acrylate is used in an amount of 35.0 parts by weight to give an encapsulated toner. This toner is referred to as "Comparative Toner 2." The glass transition temperature assignable to the resin contained in the core material is 33.5° C., and the softening point of the Comparative Toner 2 is 130.5° C.

Comparative Example 3:

The same procedure as that of Example 1 is repeated up to the surface treatment step except that no maleic anhydride is used and that 22.0 g of the resorcinol and 3.6 g of diethyl malonate are replaced with 21.6 g of neopentyl glycol to give an encapsulated toner. This toner is referred to as "Comparative Toner 3." The glass transition temperature assignable to the resin contained in the core material is 30.2° C., and the softening point of the Comparative Toner 3 is 137.0° C.

EXAMPLE 4

To a mixture comprising 69.0 parts by weight of styrene, 31.0 parts by weight of 2-ethylhexyl acrylate and 0.9 parts by weight of divinylbenzene, 7.0 parts by weight of carbon black "44" (manufactured by Mitsubishi Kasei Corporation), 5.0 parts by weight of a copolymer consisting of maleic anhydride and styrene (molar ratio of maleic anhydride:styrene=1:3; molecular weight: 1900), 3.5 parts by weight of 2,2'-azobisisobutyronitrile, 9.5 parts by weight of 4,4'-diphenylmethane diisocyanate "Millionate MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 22.0 g of resorcinol, 3.6 g of diethyl malonate and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 85° C. and reacted for 10 hours in a nitrogen atmosphere while stirring. After cooling the reaction mixture, the dispersing agent is dissolved into 10%-aqueous hydrochloric acid. The resulting mixture is filtered, and the obtained solid is washed with water, dried under a reduced pressure of 20 mmHg at 45° C. for 12 hours and classified with an air classifier to give the encapsulated toner with an average particle size of 9 μm whose shell is made of a resin having a thermally dissociating urethane bond.

To 100 parts by weight of this encapsulated toner, 0.4 parts by weight of hydrophobic silica fine powder (Nippon Aerozil Ltd.: R-972) is added to obtain the toner according to the present invention. This toner is referred to as "Toner 4." The glass transition temperature assignable to the resin contained in the core material is 29.5° C., and the softening point of Toner 4 is 134.0° C.

EXAMPLE 5

100 parts by weight of a copolymer consisting of 75 parts by weight of styrene and 25 parts by weight of n-butyl acrylate and having a softening point of 75.3° C. and a glass transition temperature of 40.5° C., 6 parts by weight of copper phthalocyanine "Sumikaprint Cyanine Blue GN-O" (manufactured by Sumitomo Chemical Co., Ltd.), 5.0 parts by weight of a copolymer consisting of maleic anhydride and styrene (molar ratio of maleic anhydride:styrene=1:4; molecular weight: 3570), and 5 parts by weight of polypropylene wax "Viscol 550p" (manufactured by Sanyo Chemical Industries, Ltd.) are together premixed, melt-kneaded in a twin-screw extruder, cooled and pulverized. 40 parts by weight of this kneaded mixture are mixed with 50 parts by weight of styrene, 15 parts by weight of n-butyl acrylate, 2.5 parts by weight of 2,2'-azobis-(2,4-dimethylvaleronitrile), 9.0 parts by weight of an adduct of 3 mol of 2,4-tolylene diisocyanate with 1 mol of trimethylolpropane "Takenate D-102" (manufactured by Takeda Chemical Industries, Ltd.), and 0.5 parts by weight of xylylene-1,4-diisothiocyanate to give a polymerizable composition. This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes.

A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 27.4 g of 4-acetylcatechol, 4.0 g of dimethyl malonate, 0.8 g of 1,2-ethanedithiol and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 85° C. and reacted for 10 hours in a nitrogen atmosphere while stirring. After cooling the reaction mixture, the dispersing agent is dissolved into 10%-aqueous hydrochloric acid. The resulting mixture is filtered, and the obtained solid is washed with water, dried under a reduced pressure of 20 mmHg at 45° C. for 12 hours and classified with an air classifier to give the encapsulated toner with an average particle size of 9 μm whose shell is made of a resin having a thermally dissociating urethane bond.

To 100 parts by weight of this encapsulated toner, 0.4 parts by weight of hydrophobic silica fine powder (Nippon Aerozil Ltd.: R-972) is added to obtain the toner according to the present invention. This toner is referred to as "Toner 5." The glass transition temperature assignable to the resin contained in the core material is 35.0° C., and the softening point of Toner 5 is 134.5° C.

EXAMPLE 6

40 parts by weight of styrene-grafted carbon black "GP-E-3" (manufactured by Ryoyu Kogyo), 5.0 parts by weight of a copolymer consisting of maleic anhydride and styrene (molar ratio of maleic anhydride:-styrene=1:3; molecular weight: 1900), 4.5 parts by weight of lauroyl peroxide, 9.0 parts by weight of tolylene diisocyanate "Coronate T-100" (manufactured by Nippon Polyurethane Industry Co., Ltd.), and 0.5 parts by weight of phenyl isocyanate are added to a mixture comprising 50 parts by weight of styrene, 35 parts by weight of 2-ethylhexyl acrylate and 0.9 parts by weight of divinylbenzene to give a polymerizable composition.

This composition is added to 800 g of a 4% by weight aqueous colloidal solution of tricalcium phosphate which is preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 24.0 g of resorcinol, 3.0 g of m-aminophenol, 2.2 g of tert-butyl alcohol and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 85° C. and reacted for 10 hours in a nitrogen atmosphere while stirring. After cooling the reaction mixture, the dispersing agent is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm whose shell is made of a resin having a thermally dissociating urethane bond.

TO 100 parts by weight of the encapsulated toner, 0.4 parts by weight of hydrophobic silica fine powder (Nippon Aerozil Ltd.: R-972) is added to obtain the toner according to the present invention. This toner is referred to as "Toner 6." The glass transition temperature assignable to the resin contained in the core material is 33.0° C., and the softening point of the Toner 6 is 131.0° C.

Comparative Example 4:

The same procedure as that of Example 4 is repeated up to the surface treatment step except that no copolymer consisting of maleic anhydride and styrene is used to give an encapsulated toner. This toner is referred to as "Comparative Toner 4." The glass transition temperature assignable to the resin contained in the core material is 28.5°-5° C., and the softening point of the Comparative Toner 4 is 130.0° C.

Comparative Example 5:

The same procedure as that of Example 5 is repeated up to the surface treatment step except that no copolymer consisting of maleic anhydride and styrene is used to give an encapsulated toner. This toner is referred to as "Comparative Toner 5." The glass transition temperature assignable to the resin contained in the core material is 34.5°-5° C., and the softening point of the Comparative Toner 5 is 133.0° C.

Comparative Example 6:

The same procedure as that of Example 6 is repeated up to the surface treatment step except that no copolymer consisting of maleic anhydride and styrene is used to give an encapsulated toner. This toner is referred to as "Comparative Toner 6." The glass transition temperature assignable to the resin contained in the core material is 32.0°-0° C., and the softening point of the Comparative Toner 6 is 130.0° C.

Test Example

A developer is prepared by placing 6 parts by weight of each of the toners obtained in Examples and Comparative Examples and 94 parts by weight of spherical ferrite powder coated with styrene-methyl methacrylate copolymer resin having a grain size of 250 to 400 mesh into an polyethylene container, and mixing the above components by rotation on the roller together with the container at a rotational speed of 150 rpm for 20 minutes. The resulting developer is evaluated with respect to the electric charge, the fixing ability and the blocking resistance.

(1) Electric charge

The electric charge is measured by a blow-off type electric charge measuring device as described below. Specifically, a specific charge measuring device equipped with a Faraday cage, a capacitor and an electrometer is used. First, W (g) (about 0.15 to 0.20 g) of the developer thus prepared is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the specific charge Q/m of this toner can be calculated by the following equation:

$$Q/m\ (\mu c/g) = C \times V/m$$

Here, m is the weight of the toner contained in W (g) of the developer. When the weight of the toner in the developer is defined as T (g) and the weight of the developer as D (g), the toner concentration in the given sample can be expressed as T/D×100(%), and m can be calculated as shown in the following equation:

$$m(g) = W \times (T/D)$$

The measurement results under normal conditions of the electric charge of the developer prepared are shown in Table 1.

In addition, the electric charge of the toners after copying 50,000 sheets is measured, and the image quality determined by the extent of background contamination generated during the continuous copying test and the scattering of the toner in the device are also evaluated and shown together in Table 1.

TABLE 1

| | Electric Charge (μc/g) (23° C., 50% RH) | | During Continuous Copying Test | |
|---|---|---|---|---|
| | At Start | After Copying 50,000 Sheets | Image Quality | Toner Scattering in Machine |
| Toner 1 | −19.0 | −18.5 | Good | None |
| Toner 2 | −16.3 | −17.0 | Good | None |
| Toner 3 | −20.5 | −21.0 | Good | None |
| Toner 4 | −17.5 | −18.0 | Good | None |
| Toner 5 | −18.0 | −17.5 | Good | None |
| Toner 6 | −18.5 | −18.0 | Good | None |
| Comparative Toner 1 | −10.0 | −5.0 | Much Contamination | Numerous |
| Comparative Toner 2 | −8.5 | −3.5 | Much Contamination | Numerous |
| Comparative Toner 3 | −10.5 | −4.0 | Much Contamination | Numerous |
| Comparative Toner 4 | −5.5 | +0.5 | Much Contamination | Numerous |
| Comparative Toner 5 | −4.0 | +1.0 | Much Contamination | Numerous |
| Comparative Toner 6 | −5.0 | +0.5 | Much Contamination | Numerous |

(2) Fixing ability

The fixing ability is evaluated by the method as described below. Specifically, each of the developers prepared as described above is loaded on a commercially available photographic copying machine to develop images. The copying machine is equipped with a selene-arsenic photoconductor; a fixing roller having a rotational speed of 255 mm/sec; a fixing device with variable heat-and-pressure and temperature; and an oil applying device being removed from the copying machine. By controlling the fixing temperature from 100° C. to 220° C., the fixing ability of the formed images and the offsetting properties are evaluated. The results are shown in Table 2.

The lowest fixing temperature used herein is the temperature of the fixing roller at which the fixing ratio of the toner exceeds 70%. This fixing ratio of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing ratio from this density value and a density value before the eraser treatment using the following equation.

$$\text{Fixing ratio} = \frac{\text{Image density after eraser treatment}}{\text{Image density before eraser treatment}} \times 100$$

(3) Blocking resistance

The blocking resistance is determined by evaluating the extent of the generation of agglomeration of particles after allowing the toner to stand under a temperature of 50° C. and a relative humidity of 40% for 24 hours. The results are also shown in Table 2.

TABLE 2

| | Lowest Fixing Temp. (°C.) | Low-Temp. Offset Disappearing Temp. (°C.) | High-Temp. Offset Generating Temp. (°C.) | Blocking Resistance |
|---|---|---|---|---|
| Toner 1 | 120 | 105 | 220 < | Good |
| Toner 2 | 119 | 105 | 220 < | Good |
| Toner 3 | 122 | 105 | 220 < | Good |
| Toner 4 | 123 | 105 | 220 < | Good |
| Toner 5 | 120 | 100 | 220 < | Good |
| Toner 6 | 125 | 105 | 220 < | Good |
| Comparative Toner 1 | 115 | 100 | 220 < | Good |
| Comparative Toner 2 | 118 | 105 | 220 < | Good |
| Comparative Toner 3 | 170 | 110 | 220 < | Good |
| Comparative Toner 4 | 123 | 105 | 220 < | Good |
| Comparative Toner 5 | 120 | 100 | 220 < | Good |
| Comparative Toner 6 | 124 | 105 | 220 < | Good |

As is clear from Table 1, with respect to Toners 1 through 6 according to the present invention, the values for the electric charges are appropriate, showing only a small change of electric charge after continuous copying of 50,000 sheets, thereby maintaining excellent image quality. However, the Comparative Toners 1 through 6 showed low values for the electric charges, and in certain cases (Comparative Toners 4 through 6) their polarity is reversed after copying 50,000 sheets. In addition, when such comparative toners are used, the contamination of background takes place during the continuous copying operation presumably due to the presence of a large number of reversed charged particles, and the scattering of the toners in the copying machine also takes place.

Further, as is clear from Table 2, in the Toners 1 through 6 and Comparative Toners 1, 2, 4, 5 and 6, since the shell of the encapsulated toner comprises a resin having a thermally dissociating bond according to the present invention, their lowest fixing temperatures are low, the non-offsetting region is wide, and they have no problems with regard to the blocking resistance. However, although Comparative Toner 3 has no problems with regard to the non-offsetting region and the blocking resistance, its lowest fixing temperature is high.

What is claimed is:

1. An encapsulated toner for heat-and-pressure fixing comprising a heat-fusible core material containing at least a coloring agent and a shell formed thereon so as to cover the surface of the core material; wherein said core material comprises a thermoplastic resin as its main component and a copolymer having one or more acid anhydride groups added as one component of a core material resin-constituting material at the time of encapsulation; and wherein the main component of the shell is a resin prepared by reacting:

(A) an isocyanate and/or isothiocyanate compound comprising:

(1) 0 to 30 mol % of a monovalent isocyanate and/or isothiocyanate compounds, and (2) 100 to 70 mol % of at least a divalent isocyanate and/or isothiocyanate compounds with (B) an active hydrogen compound comprising:

(3) 0 to 30 mol % of a compound having one active hydrogen atom reactive with the isocyanate and/or isothiocyanate groups and (4) 100 to 70 mol % of a compound having at least two active hydrogen atoms reactive with the isocyanate and/or isothiocyanate groups at a molar ratio of component (A) to component (B) of between 1:1 and 1:20, and wherein at least 30% of all of the bonds formed from the isocyanate and/or isothiocyanate groups are thermally dissociating bonds.

2. The encapsulated toner for heat-and-pressure fixing according to claim 1, wherein said copolymer having one or more acid anhydride groups is obtained by a polymerization reaction between (A) an $\alpha,\beta$-ethylenic copolymerizable monomer having an acid anhydride group, and (B) another $\alpha,\beta$-ethylenic copolymerizable monomer.

3. The encapsulated toner for heat-and-pressure fixing according to claim 2, wherein said (A) $\alpha,\beta$-ethylenic copolymerizable monomer having an acid anhydride group is selected from the group consisting of itaconic anhydride, crotonic anhydride, and the compounds represented by the following formula:

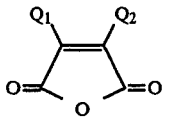

wherein $Q_1$ and $Q_2$ independently represents a hydrogen atom, an alkyl group having 1 to 3 carbon atoms or a halogen atom.

4. The encapsulated toner for heat-and-pressure fixing according to claim 2, wherein said (A) $\alpha,\beta$-ethylenic copolymerizable monomer having an acid anhydride group is maleic anhydride or citraconic anhydride.

5. The encapsulated toner for heat-and-pressure fixing according to claim 2, wherein said (B) other $\alpha,\beta$-ethylenic copolymerizable monomer is selected from the group consisting of styrene, styrene derivatives and ethylenic monocarboxylic acids and the esters thereof.

6. The encapsulated toner for heat-and-pressure fixing according to claim 1, wherein said copolymer having one or more acid anhydride groups is obtained by a polymerization reaction between 5 to 95 parts by weight of (A) an $\alpha,\beta$-ethylenic copolymerizable monomer having an acid anhydride group and 95 to 5 parts by weight of (B) another $\alpha,\beta$-ethylenic copolymerizable monomer.

7. The encapsulated toner for heat-and-pressure fixing according to claim 1, wherein said copolymer having one or more acid anhydride groups is a copolymer consisting of styrene and maleic anhydride, and the content of said copolymer in the heat-fusible core material is 0.1 to 30.0% by weight.

8. The encapsulated toner for heat-and-pressure fixing according to claim 1, wherein said thermally dissociating bond is a bond derived from reacting phenolic hydroxyl and/or thiol groups with the isocyanate and/or isothiocyanate groups.

9. The encapsulated toner for heat-and-pressure fixing according to claim 8, wherein the compound having a phenolic hydroxyl group is one or more compounds selected from the group consisting of the compounds represented by Formula (I), Formula (II) and Formula (III):

Formula (I):

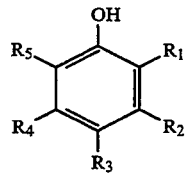

(I)

wherein $R_1$, $R_2$, $R_3$, $R_4$ and $R_5$ each independently represents a hydrogen atom, an alkyl group having 1 to 9 carbon atoms, an alkenyl, alkoxy, alkanoyl, carboalkoxy or aryl group or a halogen atom;

Formula (II):

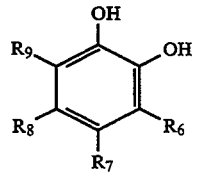

(II)

wherein $R_6$, $R_7$, $R_8$ and $R_9$ each independently represents a hydrogen atom, an alkyl group having 1 to 6 carbon atoms, an alkenyl, alkoxy, alkanoyl, carboalkoxy or aryl group or a halogen atom; and Formula (III):

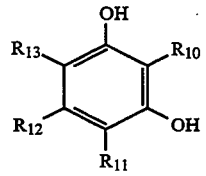

(III)

wherein $R_{10}$, $R_{11}$, $R_{12}$ and $R_{13}$ each independently represents a hydrogen atom, an alkyl group having 1 to 6 carbon atoms, an alkenyl, alkoxy, alkanoyl, carboalkoxy or aryl group or a halogen atom.

10. The encapsulated toner for heat-and-pressure fixing according to claim 8, wherein the isocyanate group reactive with a phenolic hydroxyl group and/or thiol group is directly bonded to the aromatic ring.

11. The encapsulated toner for heat-and-pressure fixing according to claim 1, wherein the glass transition temperature of said thermoplastic resin used as the main component of the heat-fusible core material is 10° C. to 50° C.

12. The encapsulated toner for heat-and-pressure fixing according to claim 1, wherein the softening point of the encapsulated toner is 80° to 150° C.

13. The encapsulated toner for heat-and-pressure fixing according to claim 1, wherein said heat-fusible core material contains a particulate magnetic material.

14. A method for production of an encapsulated toner for heat-and-pressure fixing comprising a heat-fusible core material containing at least a coloring agent and a shell formed thereon so as to cover the surface of the core material, comprising the steps of forming a heat-fusible core material by using a core material resin-constituting material containing a copolymer having one or more acid anhydride groups; and forming a shell thereon by using as the main components a resin prepared by reacting:

(A) an isocyanate and/or isothiocyanate compound comprising:

(1) 0 to 30 mol % of a monovalent isocyanate and/or isothiocyanate compounds, and
(2) 100 to 70 mol % of at least a divalent isocyanate and/or isothiocyanate compounds with (B) an active hydrogen compound comprising:
(3) 0 to 30 mol % of a compound having one active hydrogen atom reactive with the isocyanate and/or isothiocyanate groups and
(4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the bonds formed from the isocyanate and/or isothiocyanate groups are thermally dissociating bonds.

* * * * *